US007922530B2

(12) United States Patent
Chazottes et al.

(10) Patent No.: US 7,922,530 B2
(45) Date of Patent: Apr. 12, 2011

(54) ELECTRICAL CONNECTOR GROMMET WITH AXIAL AND RADIAL EXTENDING FLANGE

(75) Inventors: Frédéric Chazottes, Houx (FR); Christian Campfort, Fresnay le Gilmert (FR)

(73) Assignee: FCI, Versailles (FR)

( * ) Notice: Subject to any disclaimer, the term of this patent is extended or adjusted under 35 U.S.C. 154(b) by 169 days.

(21) Appl. No.: 11/918,263

(22) PCT Filed: Apr. 11, 2005

(86) PCT No.: PCT/EP2005/005204

§ 371 (c)(1), (2), (4) Date: Jan. 23, 2009

(87) PCT Pub. No.: WO2006/108442

PCT Pub. Date: Oct. 19, 2006

(65) Prior Publication Data

US 2009/0298317 A1 Dec. 3, 2009

(51) Int. Cl.
*H01R 13/40* (2006.01)

(52) U.S. Cl. ..... 439/587

(58) Field of Classification Search ..... 439/556, 439/588, 587, 553, 559, 548, 271–275
See application file for complete search history.

(56) References Cited

U.S. PATENT DOCUMENTS

| | | | | |
|---|---|---|---|---|
| 5,451,717 | A * | 9/1995 | Itou | 174/77 R |
| 5,951,059 | A * | 9/1999 | Kitamura | 285/24 |
| 6,053,753 | A | 4/2000 | Kunkle | 439/275 |
| 6,203,348 | B1 * | 3/2001 | Fukuda | 439/275 |
| 6,231,388 | B1 * | 5/2001 | Murakami et al. | 439/587 |
| 6,254,428 | B1 | 7/2001 | Murakami et al. | 439/556 |
| 7,033,216 | B2 * | 4/2006 | Ito | 439/587 |
| 2001/0041470 | A1 | 11/2001 | Makita | 439/271 |
| 2002/0052142 | A1 * | 5/2002 | Ishikawa et al. | 439/587 |

FOREIGN PATENT DOCUMENTS

| | | | |
|---|---|---|---|
| EP | 1 172 896 | A2 | 1/2002 |
| FR | 2 844 644 | | 3/2004 |
| JP | 5531201 | A | 8/1953 |
| JP | 62183373 | A | 8/1987 |
| JP | 08200567 | A2 | 8/1996 |
| JP | 2000030796 | A2 | 1/2000 |

* cited by examiner

*Primary Examiner* — Chandrika Prasad
(74) *Attorney, Agent, or Firm* — Harrington & Smith

(57) ABSTRACT

This grommet-type joint includes a plug member, and a plurality of through passages for wires, said passages extending in an axial direction (X), and at least one peripheral flange, which projects outwards from said plug member, said flange being provided to sealingly engage a peripheral inner surface of a connector housing. Said flange axially projects rearwards from the rear side of the plug member, whereby the contact area of the flange with said inner surface is at least partially offset with respect to said rear side in the axial direction (X).

16 Claims, 2 Drawing Sheets

ELECTRICAL CONNECTOR GROMMET WITH AXIAL AND RADIAL EXTENDING FLANGE

BACKGROUND OF THE INVENTION

The invention relates to grommet-type joints for electrical connectors, and to electrical connectors which are sealed by means of such joints.

Grommet-type joints commonly used in the art are arranged in dedicated rear skirts of connector housings and held in place by a grid, which bears on the grommet rear side and which is releasably fastenable to the housing.

More specifically, the invention relates to grommets comprising a plug member having a front side and a rear side, and a plurality of through passages for wires, said passages extending in an axial direction from the rear side to the front side, and at least one peripheral flange, which projects outwards from said plug member, said flange being provided to sealingly engage a peripheral inner surface of a connector housing.

In such known grommets, the peripheral flange is formed by a peripheral lip which radially projects from the outer surface of the plug. The peripheral sealing contact with the inner surface of the housing is thus made in an axial section which is comprised in the section where the passages are individually sealed on the wires.

With such grommets, the peripheral sealing and the individual sealing are mutually influence, whereby it is made very difficult to adapt one particular grommet design to various housing designs.

Moreover, it is made difficult to optimize both peripheral sealing features and individual sealing features of such grommets.

SUMMARY OF THE INVENTION

It is an object of the invention to provide an improved joint for electrical connector of the above-defined type, which overcomes at least one of the above-mentioned drawbacks.

Accordingly, the invention provides a grommet-type joint of the above-defined type, wherein the flange axially projects rearwards from the rear side of the plug member, whereby the contact area of the flange with said inner surface is at least partially offset with respect to said rear side in the axial direction.

In addition, this feature makes it possible to provide the individual sealing section close to the terminal accommodating chamber, while the peripheral sealing is provided in a functional housing area, the dimensions of which are less critical.

The invention will be better understood on reading the following description of one particular embodiment of the invention, given as a non-limiting example.

DETAILED DESCRIPTION OF ONE PREFERRED EMBODIMENT

Figure 1:
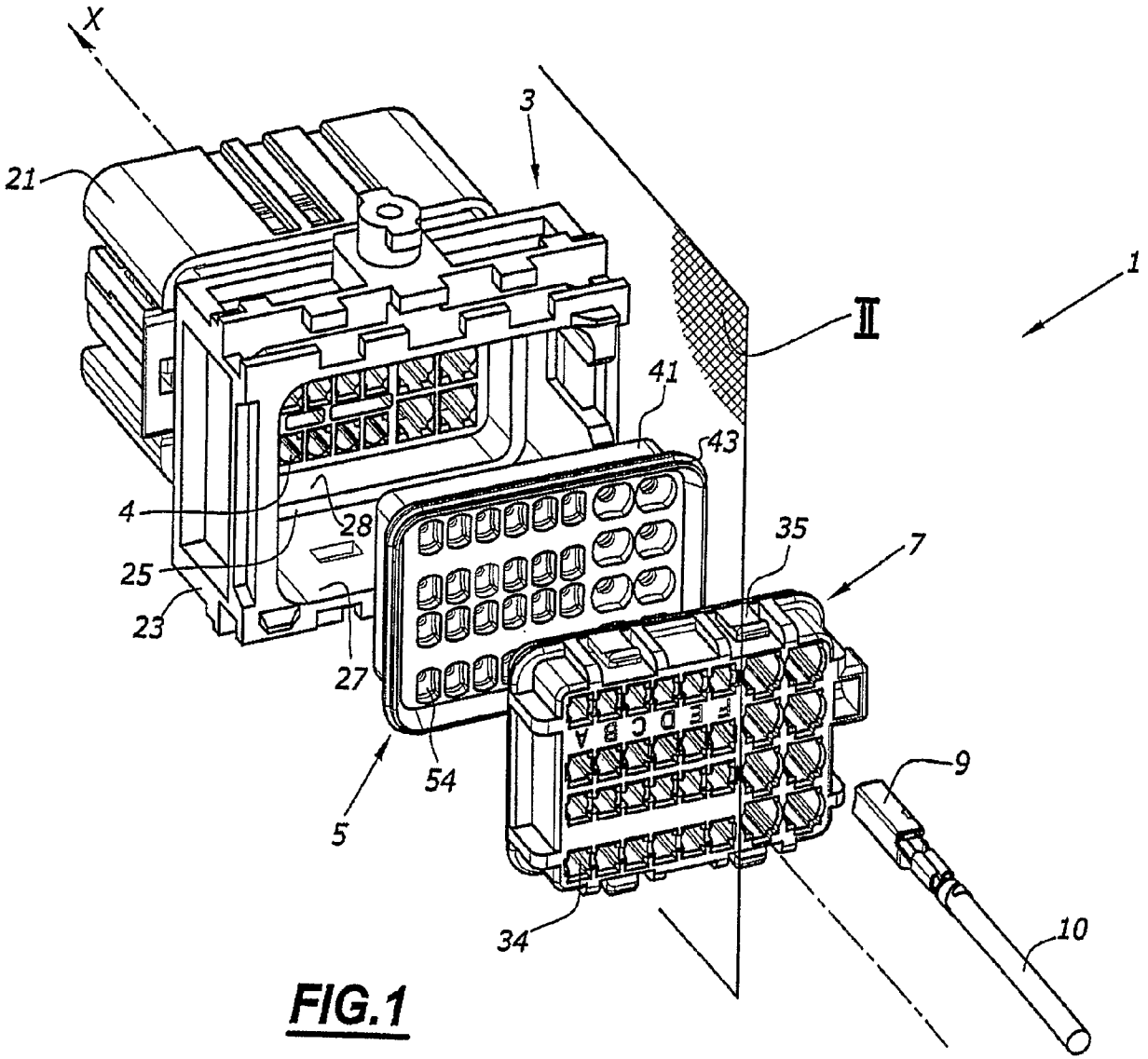
FIG. 1 is a partial exploded view of an electrical connector provided with a grommet joint of the invention.

A connector comprising a grommet-type joint (hereafter "grommet") according to the invention is illustrated on FIGS.

1 and 2. This connector is of a type used in an automotive application, and is intended to mate with a counterpart connector (not shown).

On the Figures, the mating direction is referenced as X axis, which is oriented from the connector towards the counterpart.

The orientation or position terms used in the present description refer to this mating axis X. In particular, the terms "forward" or "front" read as oriented in the mating direction.

The multi-way connector 1 shown on the Figures comprises an insulating housing 3, wherein a plurality of terminal accommodating chambers 4 are formed, a grommet 5, and a rear grid 7.

The connector also comprises a plurality of terminals 9 crimped at the end of respective wires 10, and fixedly arranged in respective accommodating chambers 4 of the housing 3.

Only one of the terminals is shown on the Figures.

The connector also has a secondary locking device 11 (shown in use on FIG. 2), which is mounted and fastened on a front section of the housing 3. Said secondary locking device is provided to ensure that the terminals 9 are in a proper functional position in their respective chambers 4, and provides a high retention force of the terminals in the respective chambers.

The housing 3 has a generally parallelepipedic front portion 21, wherein the accommodating chambers 4 are formed as through passages, and a rear skirt 23.

Said rear skirt 23 mainly consists in a peripheral outer wall, which is generally parallelepiped-shaped and which projects rearwards and outwards from the rear end of the front portion 21. The skirt 23 defines an inner recess, opened at the rear end, for accommodating the grommet 5 and the grid 7. The skirt 23 has an inner annular surface 25 formed between a rear inner peripheral surface 27 and a front inner peripheral surface 28 of a lower section, and defining an axial abutment.

The housing 3 is preferably integrally made of a plastic material.

The grid 7 is also preferably integrally made of a plastic material, and is essentially made as a plate having through axial passages 34 corresponding to the chambers 4. The grid 7 also has locking means 35 provided to releasably fasten the grid in the skirt 23 in its use position.

The grommet 5 essentially comprises a plug member 41, and a peripheral flange 43 projecting from the plug member 41.

It is integrally made in a resilient elastomeric material.

The plug member 41 has a substantially parallelepipedic shape, with opposed rear side 45 and front side 47, and a peripheral surface 49. The peripheral surface 49 is designed to fit in the front inner surface 28 of the skirt.

The plug member 41 is formed with through passages (through holes) 54 corresponding to and aligned with the respective passages 34 and chambers 4, in use configuration. The passages 54 thus extend axially from the rear side 45 to the front side 47 of the plug member 41.

The plug member 41 has a pair of annular, axially spaced apart, inner lips 57, provided in each passage 54, said inner lips thus defining two deformable narrow sections. In use, the inner lips 57 sealingly engage the respective wire and provide inner individual sealing on wire at said narrow sections, as shown on FIG. 2.

The flange 43 projects outwards, both radially and axially, from the plug member 41. It has a peripheral surface 59, which is substantially parallelepipedic in shape, and a peripheral outer lip 61, which radially projects from said peripheral surface 59.

Figure 2:
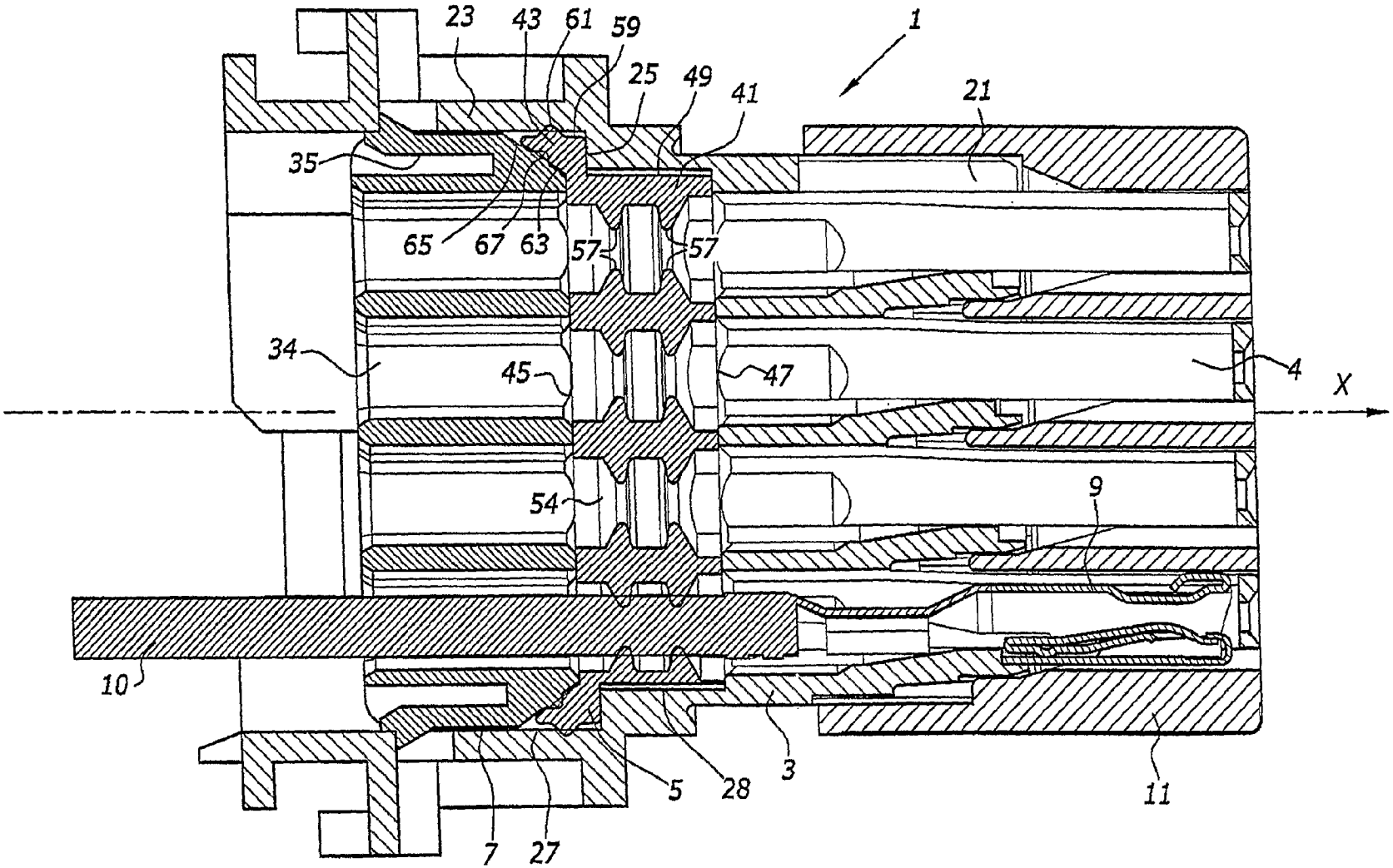
FIG. 2 is a sectional view of the assembled connector parts shown on FIG. 1, in the axial median plane II of terminal accommodating chambers.

In use, as can be seen on FIG. 2, said outer lip 61 defines the contact area of the flange 43 with the housing rear inner surface 27 and the peripheral sealing section on the housing 3.

The flange 43 has an inner plane surface 63 which is inclined with respect to the X axis, whereby the flange has a generally triangular cross-section.

The grid 7 has a corresponding inclined surface 65, sloping forward to the X axis, and provided to engage the surface 63. The grid 7 is also formed with projections 67 projecting perpendicularly from the inclined surface 65.

Referring to FIG. 2, showing the connector parts in use configuration, it should be noted that the grid 7 axially bears on the flange 43, while the front side 47 of the plug member 41 axially bears on an annular inner shoulder of the housing 3. The flange 43 also comes into abutment on the annular surface 25.

The grid 7 is fastened in the housing in an axial position where the inclined surfaces 63, 65 mutually engage, the projections 67 engaging the surface 63 by penetrating the latter.

The grid 7 thus provides a slight axial compression effect on the grommet 5, and forces the flange 43 to a slight radial expansion, whereby the lip 61 engages the inner surface 27 under a gentle pressure.

It will be appreciated that, in use, the peripheral sealing section is rearwards offset with respect to the rear side 45 of the plug member 41 in the axial direction X, and with respect to the individual inner sealing sections.

The invention claimed is:

1. A grommet-type joint for an electrical connector, comprising a plug member having a front side and a rear side, and a plurality of through passages for wires, said passages extending in an axial direction (X) from the rear side to the front side, and at least one peripheral flange, which projects outwards from said plug member, said flange being sized and shaped to sealingly engage a peripheral inner surface of a connector housing, in which housing a plurality of terminal accommodating chambers are formed and configured to receive a plurality of terminals, wherein said flange axially projects rearwards from the rear side of the plug member, whereby a contact area of the flange with said inner surface is at least partially offset with respect to said rear side in the axial direction (X).

2. A grommet-type joint as claimed in claim 1, wherein said plug member has at least one annular inner lip provided in each passage, said inner lip defining a deformable narrow section in each passage, and wherein said flange is axially spaced from said narrow sections.

3. A grommet-type joint as claimed in claim 1, wherein said plug member has at least a pair of such axially spaced apart inner lips provided in each passage.

4. A grommet-type joint as claimed in claim 1, wherein said flange has a substantially cylindrical peripheral surface.

5. A grommet-type joint as claimed in claim 1, wherein said flange has a substantially parallelepipedic peripheral surface.

6. A grommet-type joint as claimed in claim 4, wherein said flange peripheral surface is provided with a radially projecting peripheral outer lip, said outer lip defining the contact area of the flange with said housing inner surface.

7. An electrical connector comprising an insulating housing, and a grommet-type joint as claimed in claim 1, which is arranged in said housing.

8. An electrical connector as claimed in claim 7, further comprising a grid having axial passages corresponding to the passages of the joint, said grid being fastened in the housing in a position where it axially bears on the flange, whereby said flange is axially compressed in the housing.

9. An electrical connector as claimed in claim 7, wherein the grid and the flange have complementary inclined surfaces with respect to the axial direction (X), which are provided to come into mutual engagement, such that the grid radially presses the flange on the peripheral inner surface of the housing.

10. An electrical connector as claimed in claim 9, wherein the flange has a generally triangular cross-section.

11. An electrical connector as claimed in claim 9, wherein the grid has projections which project from the inclined surface to engage the complementary inclined surface of the flange.

12. An electrical connector comprising:

an insulating housing comprising a plurality of terminal mounting chambers adapted to have electrical terminals mounted therein, and a grommet-type joint arranged in said housing, wherein said grommet-type joint comprises:

a plug section having a front side and a rear side, and a plurality of through passages, said passages extending in an axial direction from the rear side to the front side, and a flange, which projects outwards from said plug section, said flange sealingly engaging an inner surface of the housing, wherein said flange projects in an axial rearward direction from the rear side of the plug section, wherein said flange projects in a radial outward direction from the rear side of the plug section, and wherein a contact area of the flange with said inner surface extends past said rear side in the axial rearward direction.

13. An electrical connector as in claim 12, further comprising a grid having axial passages corresponding to the passages of the joint, said grid being fastened in the housing in a position where it axially bears on the flange, whereby said flange is axially compressed in the housing.

14. An electrical connector as in claim 12, wherein the grid and the flange have complementary inclined surfaces with respect to the axial direction, which are provided to come into mutual engagement, such that the grid radially presses the flange on the inner surface of the housing.

15. An electrical connector as claimed in claim 14, wherein the flange has a generally triangular cross-section.

16. An electrical connector as claimed in claim 14, wherein the grid has projections which project from the inclined surface to engage the complementary inclined surface of the flange.

* * * * *